United States Patent [19]

Itaya et al.

[11] Patent Number: 4,480,911

[45] Date of Patent: Nov. 6, 1984

[54] DEVELOPING APPARATUS AND A DEVELOPING METHOD OF AN ELECTROSTATIC IMAGE

[75] Inventors: Masahiko Itaya; Satoshi Haneda; Makoto Tomono, all of Hachioji, Japan

[73] Assignee: Konishiroku Photo Industry Co., Ltd., Tokyo, Japan

[21] Appl. No.: 390,829

[22] Filed: Jun. 22, 1982

[30] Foreign Application Priority Data

Jun. 29, 1981 [JP] Japan ..... 56/104581

[51] Int. Cl.[3] ..... G03G 15/08

[52] U.S. Cl. ..... 355/3 DD; 355/14 D; 118/621

[58] Field of Search ..... 355/3 DD, 14 D; 118/657, 658, 651, 653, 621, 624, 644, 647

[56] References Cited

U.S. PATENT DOCUMENTS

| | | | |
|---|---|---|---|
| 4,265,197 | 5/1981 | Toyono et al. | 355/3 DD X |
| 4,292,387 | 9/1981 | Kanbe et al. | 355/3 DD X |
| 4,378,158 | 3/1983 | Kanbe | 355/3 DD |
| 4,383,497 | 5/1983 | Tajima | 355/3 DD X |

*Primary Examiner*—Arthur C. Prescott

*Attorney, Agent, or Firm*—Jordan B. Bierman

[57] ABSTRACT

In an electrostatic copying apparatus of the type in which a magnetic toner is applied to an image holder such as a drum from a developing roller which in turn receives the toner from a supply roller, a source of relative positive and negative voltages is alternately applied to the developing roller. This produces electric fields which move the toner from the supply roller to the developing roller and then to the image holder with the desired relative polarities.

11 Claims, 10 Drawing Figures

DEVELOPING APPARATUS AND A DEVELOPING METHOD OF AN ELECTROSTATIC IMAGE

BACKGROUND OF THE INVENTION

1. Field of the Invention

The present invention relates to a developing apparatus and the method of developing an electrostatic image using a single-component magnetic developer.

2. Description of the Prior Art

In the past, a magnetic brush developing method has generally been used as a developing system for a magnetic developer. This system has drawbacks that the developer may adhere to the non-image area and an image tends to become fogged due to the fact that magnetic developer has electric charges dispersed with positive and negative polarities owing to internal frictional electrification, and due to further frictional electrification caused by the contact of said developer with the electrostatic image holder etc.

Furthermore, there are drawbacks in that said developer coheres on the developing member and thereby the ability to be conveyed thereon is remarkably lowered. The primary reasons for this are considered to be that the thickness of a layer of developer on the developing member needs to be kept thin for a magnetic developer, and cohesion takes place under stress caused by the thickness-regulating plate for the developer resulting in less fluidity, and cohesion takes place under the stress of that developer located between the electrostatic image holder and the developing member.

SUMMARY OF THE INVENTION

The purpose of the present invention is to overcome such drawbacks of the past, and offer a developing apparatus and method of an electrostatic image through which a clear image with no fog is obtained.

In order to overcome these problems, the forming of a thin layer of the developer on the developing member without giving stress to the magnetic developer, restraining the contact between the latent image on the non-image area and the developer as far as possible, and making the charges of the developer with the same polarity etc. are considered necessary.

The purpose of the present invention is attained by a developing apparatus and method of an electrostatic image characterized in that the apparatus for developing such an image comprises a developing member and a developer-supplying member that supplies developer to said developing member, and an applied voltage with a waveform whereby a voltage to generate an electric field that moves developer from said developing member to the electrostatic image holder, and a voltage to generate an electric field that moves developer electrostatically from said developer-supplying member to said developing member are matched in a pulsing state and are impressed upon said developing member.

DETAILED DESCRIPTION OF THE PREFERRED EMBODIMENTS

Figure 1:
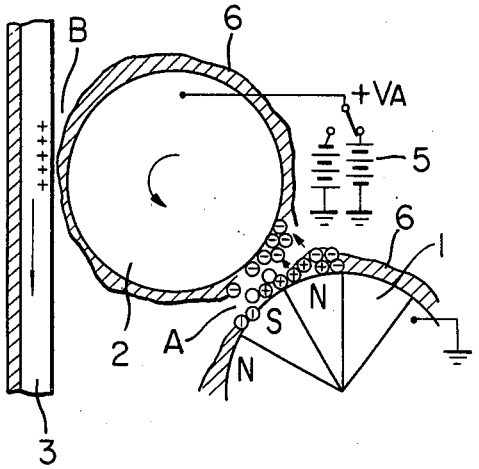
FIG. 1 is an illustrative diagram showing the principle of the developing system of the present invention.
Figure 1:
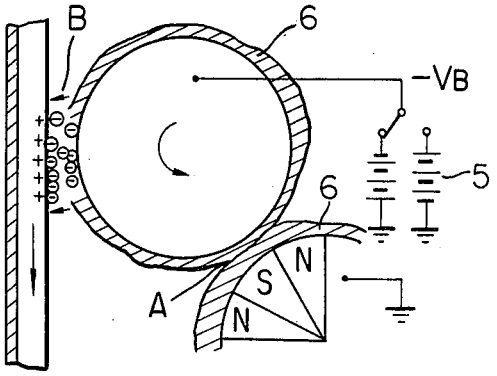

Detailed description of the present invention will be made as follows, referring to the drawings.

Figure 2:
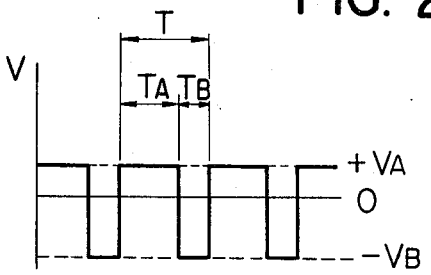
FIGS. 2, 4 and 7 show the voltage waveform to be impressed according to the present invention.
Figure 3:
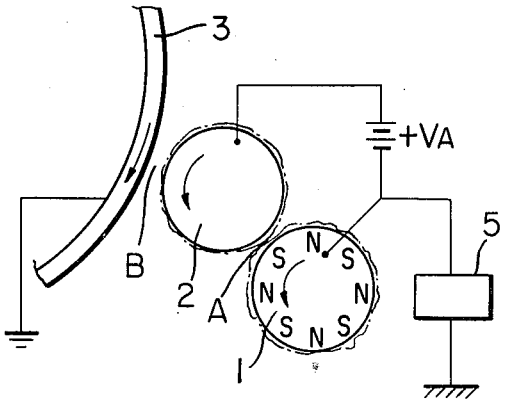
FIGS. 3, 6, 8 and 9 show schematic diagrams of the electrophotographic developing apparatus.

FIG. 1 through FIG. 3 are illustrative diagrams showing the principle of the present invention and FIGS. 1(*a*) and (*b*) are cross-sectional views of the apparatus. A single-component magnetic developer to be used in this system is preferably the one wherein magnetic powder such as magnetite etc. is dispersed therein in the amount of 20–60% by weight with a particle size of about 5–20μ; and a charge control is imposed so that the opposite polarity against that of the electrostatic latent image will be obtained. The electrostatic image holder to be used for illustration is positively charged. Therefore, said developer is charge-controlled so that it has a negative polarity.

In FIG. 1(*a*), there is shown the state in which a voltage of +VA volts is impressed upon the developing roller 2 by the power source 5. Developers with a negative polarity on the peripheral surface of the toner supply roller 1 are transferred onto the peripheral surface of the developing roller 2 at the toner transfer area A and are kept on the peripheral surface of the developing roller 2.

FIG. 1(*b*) shows the state in which the voltage is converted to −VB volts and impressed upon the developing roller 2 by the power source 5. When the electric field generated at developing area B by both electrostatic images on the electrostatic image holder 3 and the voltage to be impressed is large enough for the toner to fly from the developing roller 2 to the electrostatic latent image, the development is made with said developer transferred onto the peripheral surface of the developing roller 2, and then conveyed to the developing area B. On the other hand, developers that do not adhere to the electrostatic latent image and are in the state of a dust cloud which is the cause of the fog, are absorbed by the developing roller 2 when the voltage to be impressed is converted to +VA.

The present invention enables two functions shown in FIG. 1(*a*) and FIG. 1(*b*) to be done successively by matching −VB (volts) and the voltage VA (volts) to be impressed with a timing of TA seconds and TB seconds as shown in FIG. 2. In FIGS. 1(*a*) and 1(*b*), the power source 5 impresses VA (volts) and VB (volts) in sequence by mechanically switching, but it is preferable to use an electronic circuit (not shown) for such switching.

The value of the toner supply voltage VA is determined by both the magnetic characteristics of the developer and the magnetic force of the conveying magnet on the toner supply roller 1 and, is also affected by the distance between the developing roller 2 and the toner supply roller 1. When the voltage VA is high, the supply of the developer to the developing roller 2 is accelerated and the layer of the developer on the peripheral surface of the developing roller 2 becomes thick, which gives the effect of raising the image density. However, said voltage VA has the purpose of selectively supplying said developer having a high amount of charge from the toner supply roller to the developing roller 2, and therefore, it is not desirable that the voltage VA is too high.

The value of the developing voltage VB is such that it is not more than the voltage required with which said developer does not fly from the developing roller 2 to the non-image area on the electrostatic image holder 3, and it is the voltage at which said developer can fly to the electrostatic latent image on the image area. Further, the voltage is determined by both the amount on charge of said developer and the distance between the developing roller 2 and the electrostatic image holder 3.

Regarding the impressing time TA and TB for the voltage VA and VB, it is necessary to make the impressing time TA long and to make the impressing time TB short so that the developer with an inverted polarity will not be transferred from the toner supply roller 1 to the developing roller 2. As shown in FIG. 2, when a cycle of the impressing period of the voltage is T seconds, the impressing time TB of the voltage VB is preferably not more than 0.4T seconds. Though the preferable cycle depends on the rolling speed of the developing roller relative to the speed of the electrostatic image holder, generally the cycle is preferably 0.5–100 msec. According to experiments, the best image quality in respect of fog and sharpness was obtained with T=2 msec and TB=0.4 msec and under such condition, the controllability for each effect for the change in the voltage VA and VB was the best. However, when the impressing time TB is further shortened, it is observed that the controllability of the development is lowered.

Figure 4:
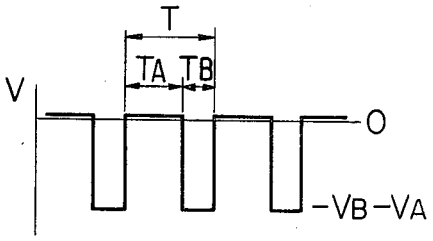

FIG. 3 shows another example of the present invention which is further improved in that a toner-supply voltage VA is constantly impressed between the toner-supply roller 1 and the developing roller 2 and developers having a high charge amount are supplied selectively. When the voltage with a waveform shown in FIG. 4 is impressed on the toner-supply roller 1 by the power source, the development is made in the developing area B under the same condition as has been explained in referring to FIG. 1.

Figure 5:
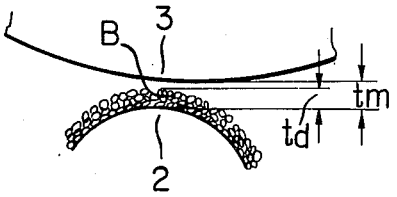
FIG. 5 is an enlarged diagram showing the state in the developing area.

It is necessary to avoid that the developer contacts the electrostatic image holder 3, and coheres and adheres electrostatically or mechanically, by setting the relationship between the distance tm between the developing roller 2 and the electrostatic image holder 3 in the developing area B, and the thickness td of the developer layer on the peripheral surface of the developing roller 2 so that its satisfies the relation of tm>td as shown in FIG. 5. Satisfactory results have been obtained experimentally with the distance tm set to 0.5 mm or less.

When the linear speed of developer movement on the toner supply roller 1 is Ls, the linear speed of the peripheral surface of the developing roller 2 is Ld and the linear speed for the movement of the latent image on the electrostatic image holder 3 is Lm, it is desirable that the setting is made so that it satisfies the relation of $Ls \geqq Ld \geqq Lm$.

Further, the cycle T shown in FIG. 2 is determined by the linear speed of movement of the electrostatic latent image on the electrostatic image holder 3, and a cycle less than 1/Lm sec causes no problem for practical use when Lm is indicated by a unit of mm.

The developing roller 2 may be either a magnetic body or a non-magnetic body, and it may further be either metal or resin or a combined body thereof; what is required is that the voltage can be impressed on the surface of the developing roller 2 and, it may be the one wherein the insulation film is provided on the surface of the metal. The toner-supply roller 1 may be either the single body of a magnetic roll or, one wherein a non-magnetic sleeve is provided about the single body of magnetic roll; what is required is that either one or both of them can rotate.

Figure 7:
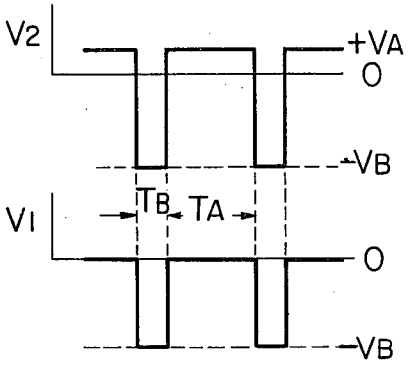
Figure 6:
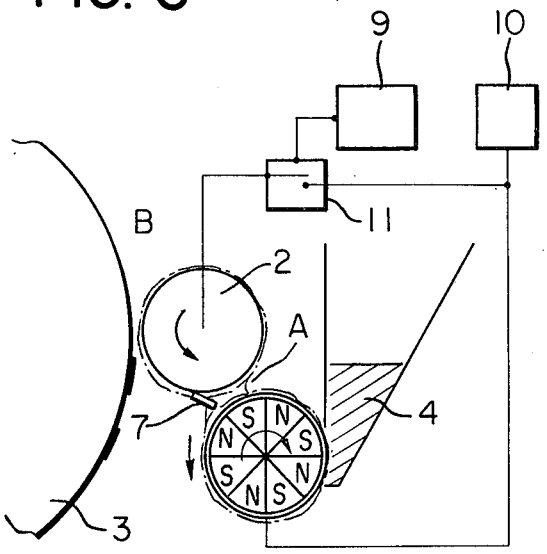
Figure 8:
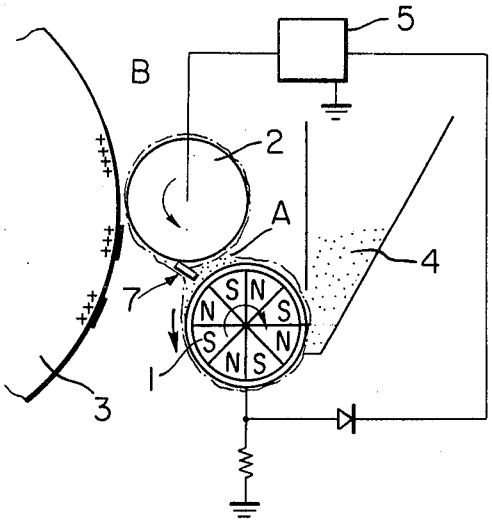

The basic pattern for impressing the voltage on the developing member has already been described and as shown in FIG. 6. It is possible to provide a DC power source 9 and a pulse power source 10 and to impress the voltages shown as V2 and V1 in FIG. 7 on the developing roller 2 and the toner supply roller 1 respectively with the aid of the switching device 11. Further, as shown in FIG. 8, it is possible to use a diode or a nonlinear element in the voltage-impressing circuit, and in FIG. 8 the power source 5 generates a voltage with a waveform shown in FIG. 2. Thus, the transfer of the developer with an undesired polarity from the toner supply roller 1 to the developing roller 2 is prevented, and further improvements in the image quality are expected.

As mentioned above, the developing apparatus and method of an electrostatic image of the present invention employs at least two rollers by the toner supply roller 1 and the developing roller 2, and is characterized in that a voltage with a compound waveform of positive and negative voltages is impressed on the developing roller 2.

In the present invention, due to the step of electrostatically transferring the developer from the toner supply roller 1 to the developing roller 2, it is possible to form several toner layers on the developing roller 2, and no toner-scattering takes place because the toner layers are held firmly. Furthermore, owing to the nearly single polarity of the developer on the developing roller 2, an extremely excellent image quality is obtained and the control of image density etc. is easy.

In the present invention it is preferable to make the thickness of the developer layer on the developer-supply roller thin for reducing frictional electrification. It is also preferable to make the thickness of the developer layer on the developer-supply roller thinner than that of the developer layer on the developer roller.

It is possible to make the developer layer on the developing roller thin as described above by adjusting properly the voltage to be impressed between the developing roller and the developer-supply roller and the relative speed between both rollers.

Other example of the present invention will be described next.

Figure 9:
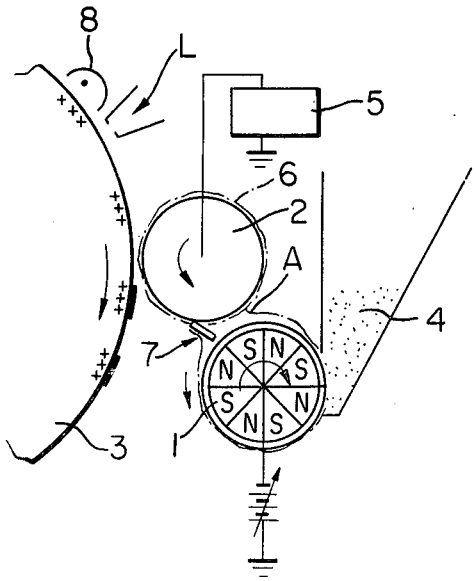

FIG. 9 shows an example wherein selenium photoreceptor is used as an image holder 3. Selenium photoreceptor vaporized on the peripheral surface of the drum moves in the direction of the arrow and receives the light L to form the electrostatic latent image after being evenly charged by the charger 8. The potential of on the image area, in this case, is +500 V.

The toner-supply roller 1 is of a structure which has a magnetic roller inside, and a non-magnetic cylindrical sleeve around the magnetic roller. Both the magnetic roller and the cylindrical sleeve are arranged to be rotatable and they rotate in the direction of the arrows. The diameter of the sleeve is 30 mmϕ; the developer is supplied from the toner container 4 and it forms the toner layer with the average thickness of 0.5 mm on the sleeve.

The developing roller 2 is an aluminum cylinder with a diameter of 30 mmϕ and has, on its surface, an insulating layer of the thin film that is Teflon-processed. The distance between the toner-supply roller 1 and the developing roller is 0.6 mm.

The voltage to be impressed on the developing roller 2 is as follows for the waveform shown in FIG. 2.

| | |
|---|---|
| VA = 300 V, | −VB = −500 V |
| T = 2 msec, | TB = 0.4 msec |

This causes the toner layer of 2–3 layers to be formed on the developing roller 2. Regarding this toner layer, there is hardly a leakage of the charge because the developing roller 2 is insulation-processed on its surface. The distance between the developing roller and the image holder 3 is 0.2 mm. Referring to FIG. 5, tm=0.2 mm, td=0.03 mm.

The magnetic developer used in this case was prepared in the following manner. That is, the following items were dissolved and kneaded and then pulverized and classified and the toner grains powder with an average diameter of 15μ thus obtained was mixed with a small amount of silica fine powder.

| | |
|---|---|
| Styrene-acryl resin "SBM 73" (made by Sanyo Kasei Kogyo Co.) | 60 weight parts |
| Magnetite "EPT 1000" (made by Toda Kogyo Co.) | 37 weight parts |
| Charge-controlling agent "Vali-fast Black 3804" (made by Orient Kagaku Kogyo Co.) | 1 weight part |
| Carbonblack "MA-8" (made by Mitsubishi Chemical Co.) | 2 weight parts |

The linear speed of the image holder 3 is 150 mm/s and the linear speed of both the developing roller 2 and the toner-supply roller 1 is 300 mm/s.

With these conditions, an image with no fog and a high sharpness was obtained.

What is claimed is:

1. In an electrostatic copying apparatus of the type in which a magnetic developer is applied to a movable electrostatic image holder from a movable developing member, which in turn receives magnetic developer from a movable supply member, the improvement comprising a power source, and means alternately supplying said developing member from said power source with voltages of effectively opposite polarity, whereby said magnetic developer is attracted from said supply member to said developing member at one time, and from said developing member to said image holder at another time to produce a latent magnetic developer image upon the latter.

2. In an electrostatic copying apparatus, the improvement according to claim 1, in which the voltage supplied to said developing member from said supply means is such as to change the charge of said developer on said developing member opposite to the charge on said image holder.

3. In an electrostatic copying apparatus, the improvement according to claim 1, in which said voltage supply means is a pulse source producing a pulse wave forming an electric field intermittently transferring the magnetic developer to the image holder.

4. In an electrostatic copying apparatus, the improvement according to claim 1, in combination with means grounding said supply member.

5. In an electrostatic copying apparatus, the improvement according to claim 1, in which said developing member is a roller.

6. In an electrostatic copying apparatus, the improvement according to claim 2, in which said developing member is a roller.

7. In an electrostatic copying apparatus, the improvement according to claim 1, in which said magnetic developer is a single component toner.

8. In an electrostatic copying apparatus, the improvement according to claim 3, in which said pulse source produces relatively positive and negative pulses of which the positive pulses have a larger duration than the negative pulses.

9. In an electrostatic copying apparatus, the improvement according to claim 8, in which the duration of the negative pulses is not greater than 0.4 times the duration of the positive pulses.

10. In an electrostatic copying apparatus, the improvement according to claim 1, in which the developing member and the supply member are rollers.

11. In an electrostatic copying apparatus, the improvement according to claim 10, in which the speeds of the developing roller, the movable image holder and the supply roller satisfy the equation:

$$Ls \geqq Ld \geqq Lm$$

in which Ls is the linear speed of the peripheral surface of the supply roller, Ld is the linear speed of the peripheral surface of the developing roller, and Lm is the linear speed of movement of the latent image on the image holder.

* * * * *